US005286018A

United States Patent [19]

Rasmussen et al.

[11] Patent Number: 5,286,018

[45] Date of Patent: Feb. 15, 1994

[54] PRINTER PAPER STACK-HANDLING APPARATUS

[75] Inventors: Steve O. Rasmussen, Vancouver; Allan G. Olson, Camas, both of Wash.

[73] Assignee: Hewlett-Packard Company, Palo Alto, Calif.

[21] Appl. No.: 954,540

[22] Filed: Sep. 29, 1992

[51] Int. Cl.[5] ..... B65H 1/08

[52] U.S. Cl. ..... 271/147; 271/250; 271/145

[58] Field of Search ..... 271/240, 248, 250, 145, 271/147

[56] References Cited

U.S. PATENT DOCUMENTS 4,056,193 11/1977 Yoshida .
4,358,102 11/1982 Hoshizaki et al. ..... 271/170
5,154,413 10/1992 Boughton et al. ..... 271/248

FOREIGN PATENT DOCUMENTS 148137 9/1983 Japan ..... 271/250
75745 4/1986 Japan ..... 271/250
203045 9/1986 Japan ..... 271/145
34855 2/1989 Japan ..... 271/250
138224 6/1991 Japan ..... 271/241

*Primary Examiner*—H. Grant Skaggs

[57] ABSTRACT

An improved printer paper stack-handling device is described. In its preferred embodiment, the stack-handling device includes a pivot member with a downwardly inclining paper top-of-stack contact surface. The device also includes a force mechanism, e.g. a leaf spring, to pivot the member into contact with the top sheet of a paper stack. The spring and the pivot member's inclined contact surface produce a variable top sheet bias for corresponding variable paper stack heights, to properly laterally align the top sheet against a fixed, opposing guide rail, for feeding to a printer input port.

20 Claims, 5 Drawing Sheets

PRINTER PAPER STACK-HANDLING APPARATUS

TECHNICAL FIELD

The present invention relates generally to improvements in paper stack-handling for printers. More particularly, the invention concerns an improved alignment mechanism for producing a variable top sheet bias force which varies with paper stack height.

BACKGROUND ART

Printers operate by printing on a piece of paper. Historically, a continuous length of paper, folded fan-style, was pin-fed to a printer by use of holes along the edge of the length of paper. The pages within such fan-style paper were defined by perforations. Use of such continuous length paper increased efficiency over prior art printers which required each page be hand fed to the printer. However, the finished printed product from continuous length paper printers required each page be separated along the perforations defining each page and along the perforations defining the holed side region used for pin-feeding to the printer. This labor-intensive task resulted in printed pages with rough, perforated edges.

More recently, printers were developed in which the single top sheet of a paper stack is fed to a printer. Such printers were an improvement over the prior art because the resulting printed page had no perforations along its edges. To maximize efficiency of single sheet printers, paper trays were developed continuously to feed single sheets from the top of the paper stack to a printer. Problems arise when two or more sheets are fed to a printer simultaneously from the paper tray. Multiple sheet intake leads to paper jams, paper slippage, and to various other problems related to the print operation. The resulting waste of paper is also of concern, particularly in view of the increasing costs of materials.

To alleviate such multiple sheet intake, stack feed sheet printers often employ mechanisms adjacent their input ports which separate sheets of paper as they are taken into the printer, as shown in co-pending U.S. patent application Ser. No. 07/954,541 entitled "Paper Pick-Up System for Printers", filed Sep. 29, 1992, and subject to common ownership herewith. The disclosure of that patent application is incorporated herein by this reference. For such separator mechanisms to function, the top sheet of a paper stack must be properly aligned for feeding into the printer's input port.

To facilitate paper alignment, an input tray having a guide rail perpendicular to the printer input port is employed. The paper stack is manually placed in the input tray with one edge of the paper stack placed against the guide rail. For proper alignment and corresponding proper separator mechanism function, the top sheet must be aligned against the guide rail prior to feed into the printer input port. To ensure proper alignment, an alignment device is used to exert a bias force on the stack properly to align the sheets therein against the guide rail for feeding to the printer. However, the bias force necessary properly to align the to-be-fed top sheet of a paper stack varies with paper stack height due to the impingement of the alignment device on multiple sheets of the stack at one time, with the stack height determining at least in part the mass of paper to be urged against the guide rail. As the paper stack height decreases, the bias force must also decrease to prevent buckling of the paper.

Conventionally, alignment devices have utilized multiple force mechanisms, e.g. multiple springs, to vary the bias force as the paper stack height decreases. In one prior art embodiment, two leaf spring force mechanisms are employed. The first, larger leaf spring steers the whole paper stack toward a guide rail. The first spring is positioned opposing the guide rail across the planar expanse of the paper stack. The second, smaller leaf spring is positioned adjacent and vertically above the first spring. The second spring contacts the top sheet of the paper stack to produce a constant bias force on the top sheet against the guide rail.

In the prior art embodiment, both springs are fixedly mounted on the printer. A paper stack is placed on a paper tray that continually rises as the paper stack height decreases. Thus, each sheet in the stack is positioned adjacent the second spring when that particular sheet is the top sheet in the stack.

Problems arise when the paper tray does not raise the top sheet to a position adjacent the second leaf spring, rendering the second spring ineffective, or when paper becomes wedged between the separate first and second springs. In addition, the two springs are not mounted on the paper support, requiring a paper support adjustment and a spring adjustment for varying paper stack widths for feed to a printer. Finally, use of two force mechanisms results in more cost than use of one force mechanism because more assembly time, materials, maintenance and design are required for the two force system.

DISCLOSURE OF THE INVENTION

The invented paper stack-handling apparatus utilizes only one force mechanism to create a varying bias force for varying paper stack heights. Use of only one force mechanism reduces the manufacturing cost because fewer parts and less assembly time are required. Maintenance costs are reduced because there are fewer moving parts and less wear. In addition, printer efficiency is increased because one force mechanism achieves the same result that previously required multiple force mechanisms working in concert. These improvements are achieved through use of an inclined top sheet contact surface on a single spring-biased pivotal member.

The preferred embodiment of the invention includes a pivotal member having an inclined top sheet contact surface and a leaf spring force mechanism. The pivotal member and the leaf spring are mounted on a support structure, which in turn is mounted on a printer structure that forms part of the printer's paper stack input tray. The pivotal member is an elongate member having a first planar expanse forming an acute angle with the planar expanse of a paper stack placed in the printer's input tray. The pivot member's first planar expanse is bounded by a first end, a second end, a bottom edge and a top edge. The first end includes a first edge, and the second end includes a second edge, the edges confronting the paper stack. The top edge also functions as the paper stack top sheet contacting surface. The top edge tapers toward the bottom edge from a higher point at the first edge to a lower point at the second edge. The pivot member has a pivot point adjacent the first end.

The leaf spring force mechanism is connected to the support structure, adjacent the pivot member, to pivot the member about its pivot axis so that the pivot member top edge contacts the top sheet of a paper stack. The force against the top sheet laterally biases the top sheet against a guide rail on the opposite side of the paper stack from the pivot member. Due to the acute angle formed between the pivot member's planar expanse and the planar surface of the paper stack, in addition to the tapering of the top edge, the pivot member contacts the top sheet of a paper stack at a region on the contact surface at varying locations for varying paper stack heights. The contact location is near the first edge for taller paper stacks and near the second edge for shorter paper stacks. Thus, the invention produces a variable moment arm in the pivot member such that the top sheet bias force decreases as the paper stack height decreases.

These and additional objects and advantages of the present invention will be more readily understood after a consideration of the drawings and the detailed description of the preferred embodiment.

DETAILED DESCRIPTION OF THE PREFERRED EMBODIMENT AND BEST MODE OF CARRYING OUT THE INVENTION

Figure 1:
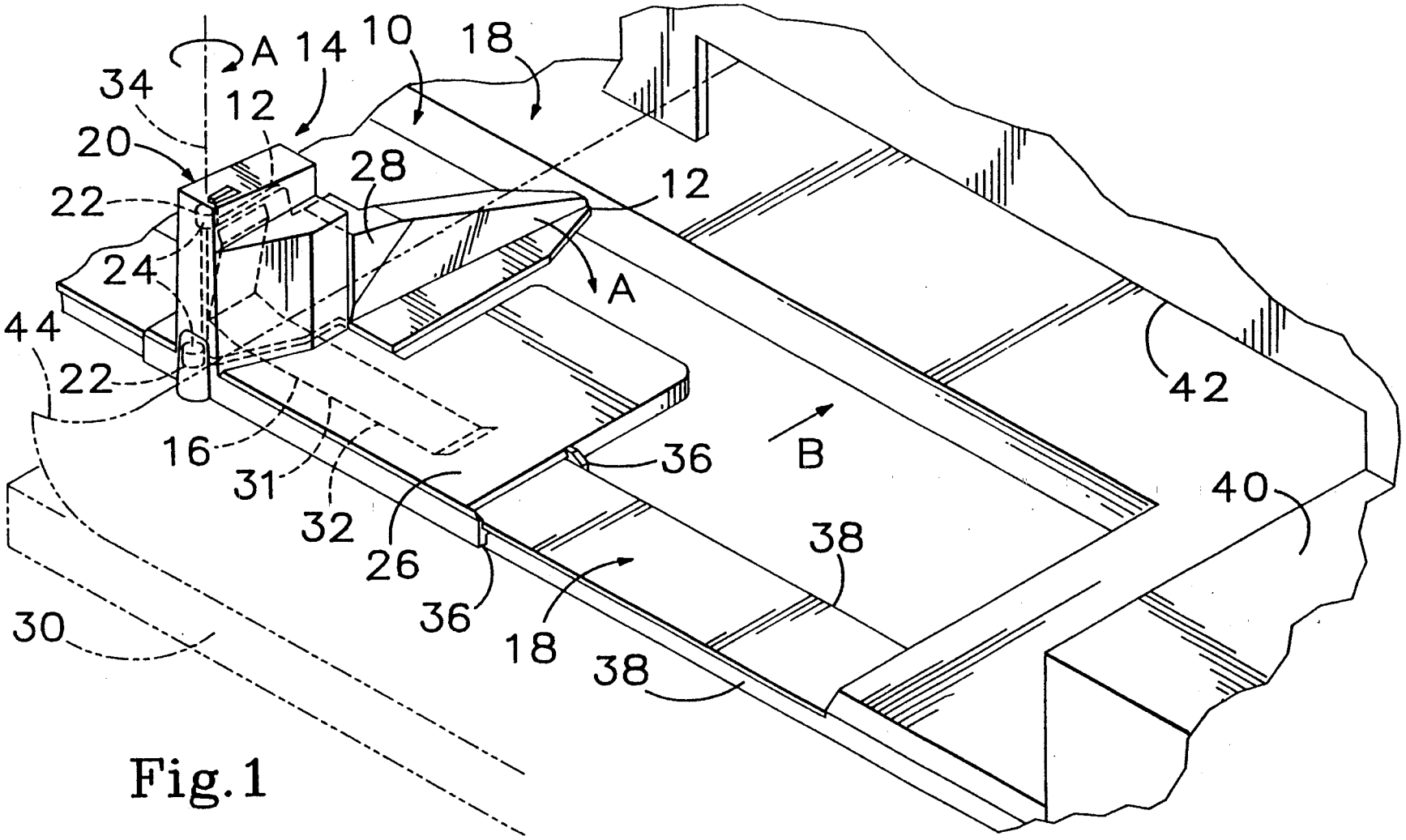
FIG. 1 is an isometric view of the paper stack handling apparatus made in accordance with the preferred embodiment of the invention.

FIG. 1 illustrates the preferred embodiment of the paper stack-handling apparatus for a printer in isometric view. The apparatus 10 includes a pivotal member 12, also called a pivot member 12, support structure 14, a force mechanism 16, and printer structure 18. Force mechanism 16 is mounted on support structure 14. Pivot member 12 is pivotally mounted on support structure 14. Preferably, support structure 14 is slidably mounted on printer structure 18.

Support structure 14 includes a hollow chamber 20 with recesses 22 therein to fittingly engage pivot points 24 of pivot member 12. Such fitting engagement facilitates pivotal movement of pivot member 12 in direction A while said pivot member 12 is mounted on support structure 14. Support structure 14 also includes a base region 26 mounted on and lying in a plane generally parallel with printer structure 18. Pivot member 12 also includes an inwardly angled lead-in-surface 28 which facilitates initial placement of a paper stack 30 on base region 26 and on printer structure 18. Lead-in-surface 28 forms an approximately 90° angle $\phi$ (FIG. 2) with the plane of base region 26. In operation, lead-in-surface 28 creates a funnel effect to urge a paper stack 30 into proper initial alignment against pivot member 12.

Also mounted on support structure 14 is force mechanism 16. Force mechanism 16 includes a spring element 31. In the preferred embodiment, spring element 31 is an L-shaped leaf spring 32. Leaf spring 32 is mounted on support structure 14, with the leaf spring extending beneath base region 26 and then upwardly into hollow chamber 20, adjacent pivot points 24 of pivot member 12. Leaf spring 32 urges pivot member 12 to pivot about pivot axis 34 in direction A and thereby contact a paper stack 30.

Support structure 14 is mounted at base region 26 on printer structure 18. Base region 26 includes two opposing, spaced capture lips 36 to fittingly engage capture tracks 38 on printer structure 18. In the preferred embodiment, support structure 14 is mounted on capture tracks of a pullout paper tray (undepicted), the pullout paper tray thereupon mounted on printer structure 18. Capture lips 36 and capture tracks 38 allow support structure 14 to be transversely slidably mounted on printer structure 18 to accommodate varying widths of paper and to adjust bias impact of member 12 on the top sheet 44.

INDUSTRIAL APPLICABILITY

In operation, a user manually places a paper stack 30 on printer structure 18 between a printer structure guide rail 40 and pivot member 12 for feeding into the printer input port 42. Top sheet 44 of the paper stack 30 must be properly aligned adjacent guide rail 40 for proper feed into input port 42, with a top sheet 44 moving in direction B into printer input port 42. Pivot member 12 pivots in direction A, to bias top sheet 44 against guide rail 40, thereby properly to align top sheet 44 for varying paper stack heights.

Figure 2:
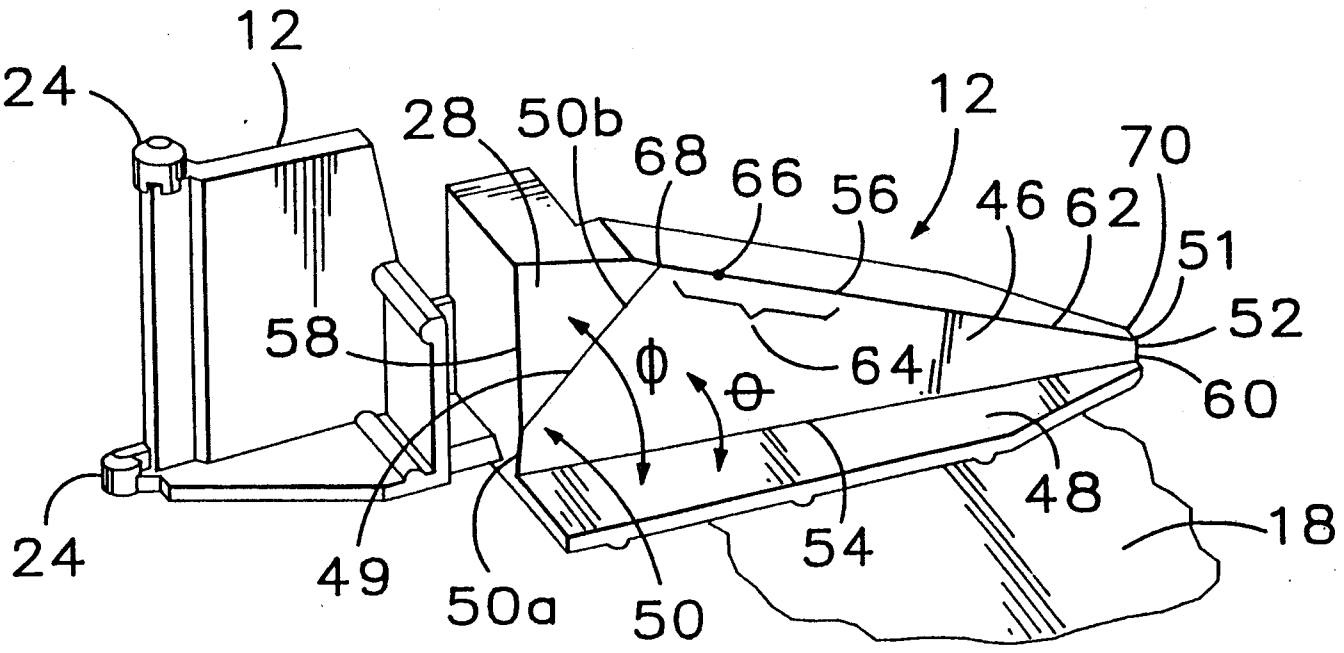
FIG. 2 is an isometric view of the pivot member made in accordance with the preferred embodiment of the invention.

FIG. 2 illustrates the preferred embodiment of the pivot member in isometric view. Pivot member 12 includes a first generally planar expanse 46 and a second generally planar expanse 48. First expanse 46 can function as a migration guide for stack 30 generally to align stack 30 against guide rail 40. Second planar expanse 48 functions as a partial support of stack 30 and lies in a plane generally parallel with printer structure 18. Paper stack 30 is placed at least in part on a portion of second expanse 48 for feeding to the printer input port 42. The planes defined by first expanse 46 and second expanse 48 create an acute angle $\theta$.

First planar expanse 46 is bounded by a first end 49, including first edge 50, having a lower portion **50*a* and an upper portion 50*b*, second end 51, including second edge 52, bottom edge 54, and top edge 56. In the preferred embodiment, top edge 56 tapers from a higher point 68 adjacent first edge upper portion 50*b*, to a lower point 70 adjacent second edge 52. Also in the preferred embodiment, a front edge 58 is adjacent first edge lower portion 50*a*, front edge 58 being the closest to the user upon manual placement of paper stack 30 (FIG. 1) on printer structure 18. Likewise, second edge 52 is rear edge 60, being the furthest edge from the user upon manual placement of paper stack 30 on printer structure 18. As understood by one skilled in the art, paper stack 30 can be fed to a printer from the front of the printer, (as in the preferred embodiment), or from the top, bottom, rear, or side of the printer. To accommodate differing paper stack feed arrangements to a printer, pivot member 12** can be correspondingly placed on the front, top, bottom, rear, or side of a printer.

Referring still to FIG. 2, top edge 56 includes top sheet contact surface 62, also called top-of-stack contacting surface 62 and contact surface 62. Contact surface 62 includes a continuum of contact regions 64. Ideally in the preferred embodiment, top sheet 44 of paper stack 30 (FIG. 1) contacts contact surface 62 at a contact point 66 within contact region 64.

Figure 3:
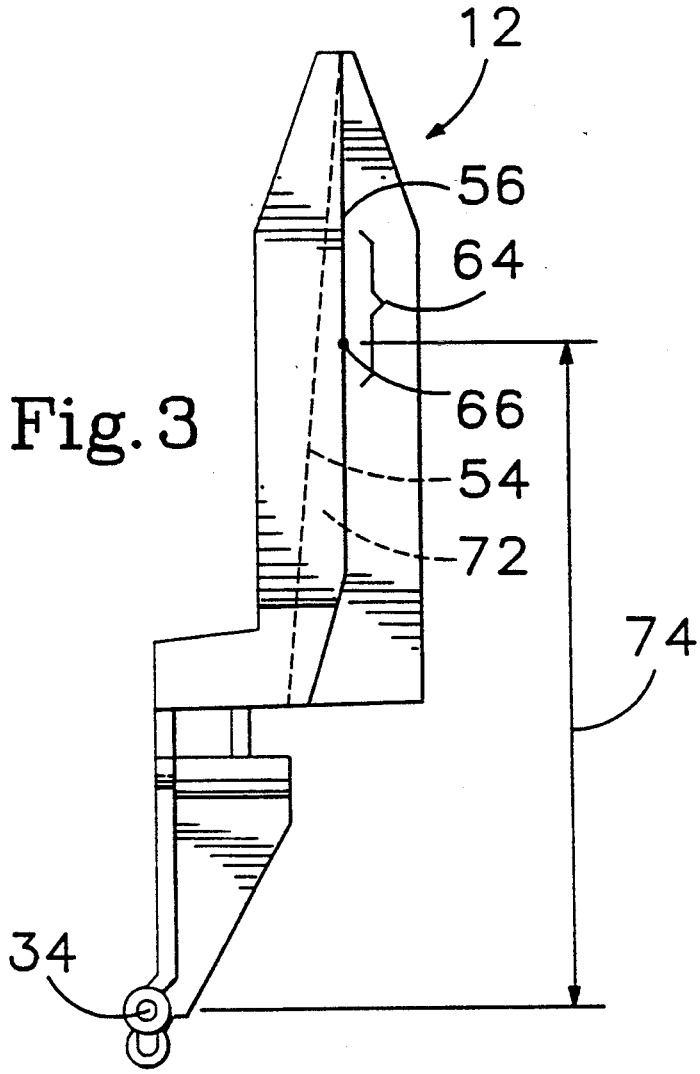
FIG. 3 is a top view of the pivot member shown in FIG. 2.

FIG. 3 shows a top view of pivotal member 12. Top edge 56 and bottom edge 54 create an overhang 72 due to acute angle $\theta$ (FIG. 2). Contact region 64, including contact point 66, and pivot axis 34 define a moment arm 74 about pivot axis 34.

Figure 4:
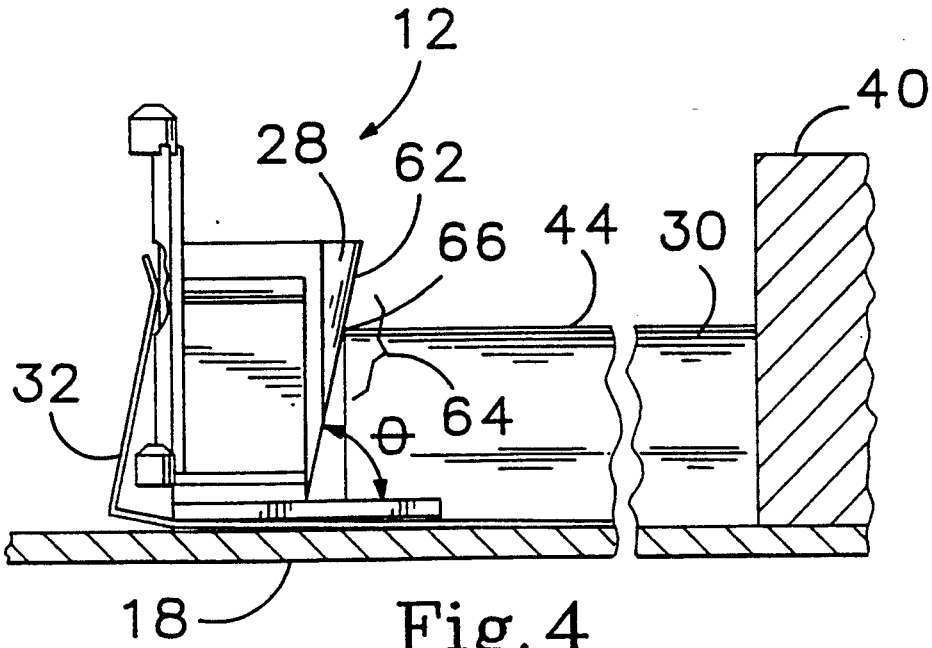
FIG. 4 is a front elevation of the pivot member, leaf spring, and guide rail shown in FIG. 2.

FIG. 4 shows pivot member 12, leaf spring 32 and printer structure 18. Top sheet 44 of paper stack 30 contacts contact surface 62 in contact region 64, or ideally, at contact point 66 therein. Paper stack 30 is aligned against guide rail 40 which is fixedly mounted on printer structure 18.

Figure 5:
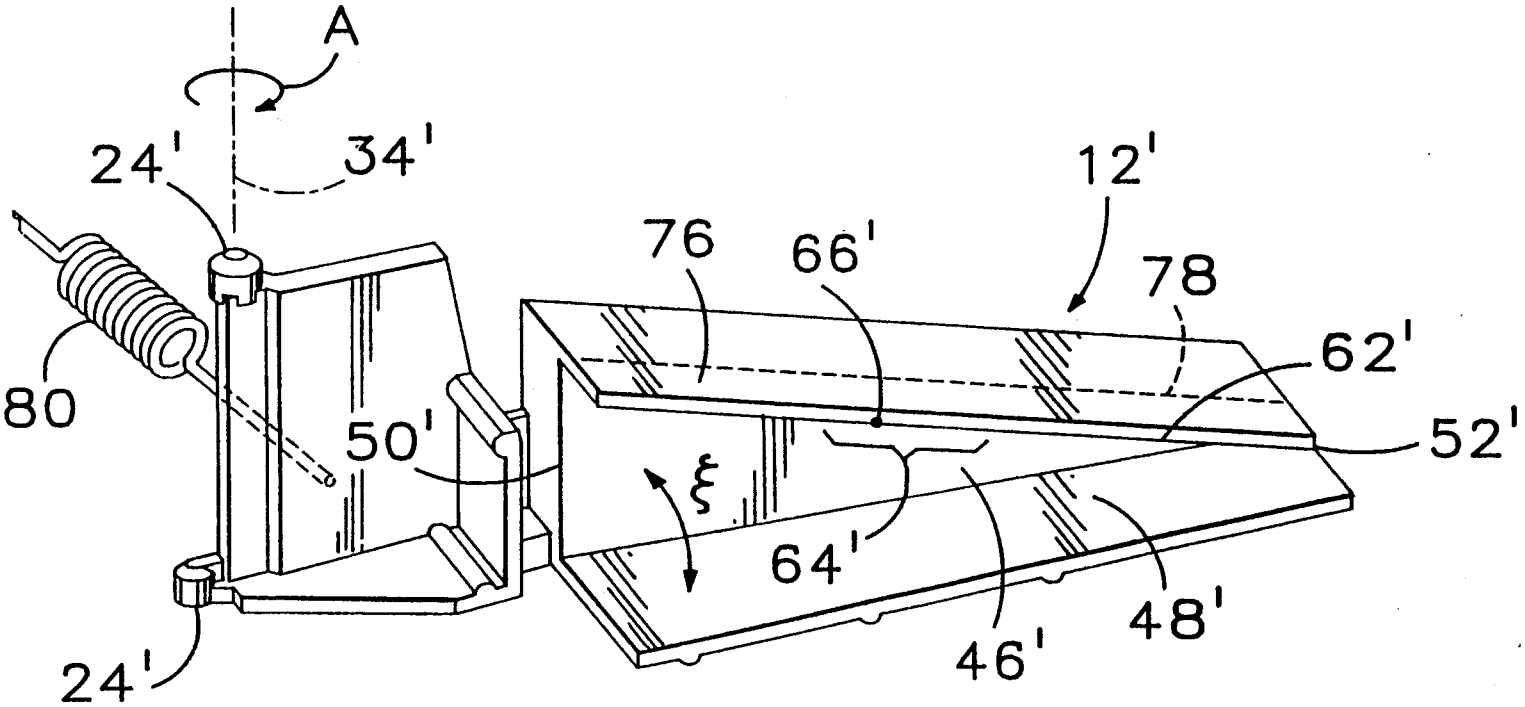
FIG. 5 is an isometric view of a modified embodiment of the pivot member of the invention.

FIG. 5 shows an isometric view of a modified embodiment of the present invention. Pivot member 12' includes a first planar expanse 46' and a second planar expanse 48'. Expanse 46' and expanse 48' form an approximately 90° angle $\xi$. First expanse 46' has a protruding ledge 76 along its top edge 78 and a top sheet contact surface 62'. Surface 62' has contact regions 64' and contact points 66' therein. Contact surface 62' is inclined from a higher elevation at first edge 50' to a lower elevation at second edge 52'. Thus, contact surface 62' contacts the top sheet 44 (FIG. 1) of a paper stack 30 at varying contact regions 64', or at a contact point 66' along the contact surface 62' for varying paper stack heights.

In operation, still referring to FIG. 5, coiled spring force mechanism 80 forces pivot member 12' to pivot at pivot points 24' around pivot axis 34' adjacent first edge 50' in direction A. Such pivotal movement urges member 12' against a top sheet 44 to bias top sheet 44 into alignment against guide rail 40 for feeding to a printer input port 42 (FIG. 1). However, in this alternative embodiment, expanse 46' does not contact paper stack 30 and correspondingly does not urge stack 30 generally into alignment against guide rail 40. In addition, in apparatus 10', a paper stack will tend to become wedged under ledge 78. Thus, the alternative embodiment achieves generally the same result as the preferred embodiment but does not align a paper stack as effectively as does apparatus 10.

Figure 6:
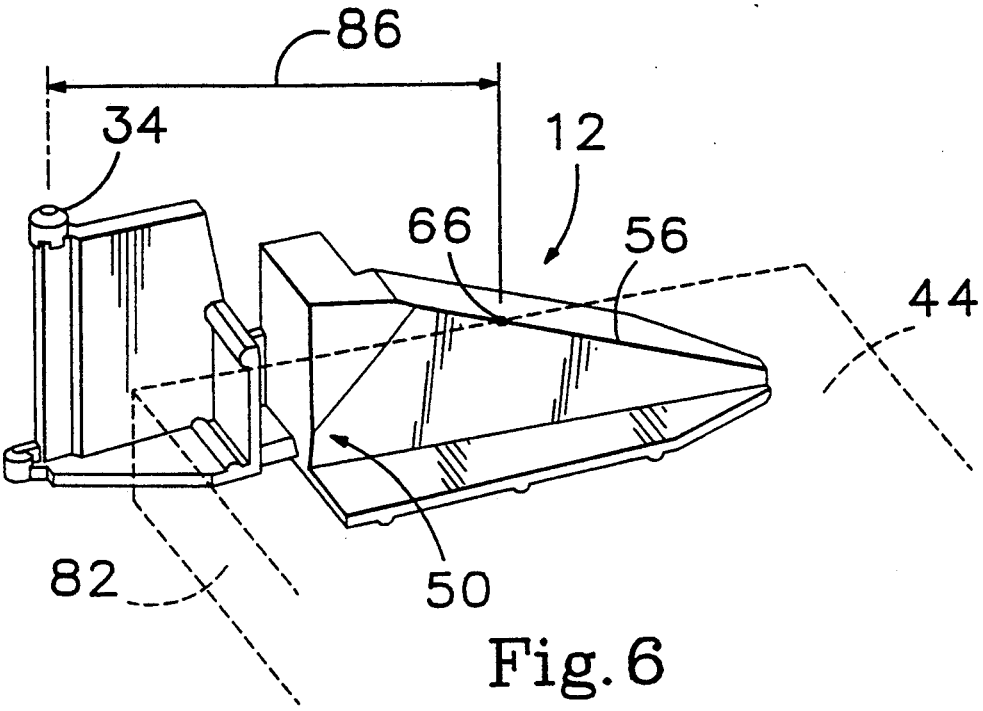
FIG. 6 is an isometric view of the pivot member with a taller paper stack in position for feeding to a printer.

FIG. 6 is an isometric view of the preferred embodiment, pivot member 12 shown with a taller paper stack 82. Top sheet 44 contacts top edge 56 at a point 66 generally adjacent first edge 50, creating a shorter moment arm 86 from pivot axis 34 to contact point 66.

Figure 7:
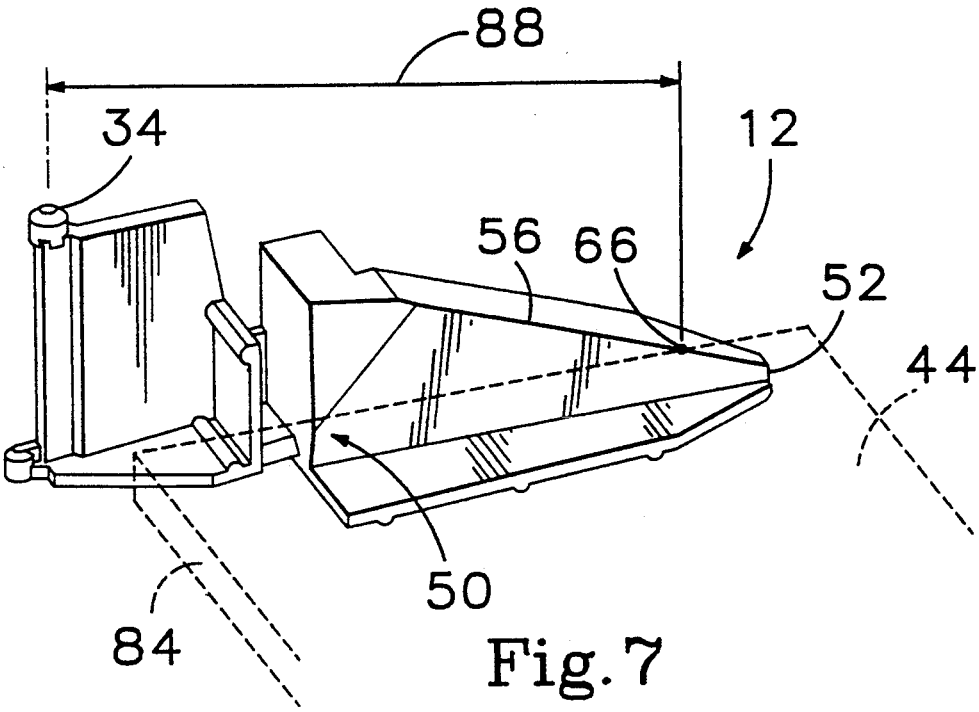
FIG. 7 is an isometric view of the pivot member with a shorter paper stack in position for feeding to a printer.

FIG. 7 is an isometric view of the preferred embodiment of the present invention pivot member 12 shown with a shorter paper stack 84. Top sheet 44 contacts top edge 56 at a point 66 generally adjacent second edge 52 creating a longer moment arm 88 from pivot axis 34 to contact point 66. Longer moment arm 88 is longer than shorter moment arm 86, therefore the bias force against top sheet 44 in FIG. 7 is less than the bias force against top sheet 44 in FIG. 6.

To produce these objects and advantages of the present invention and alternative embodiments, the structural elements can be formed through an injection molding process utilizing a lightweight, stiff, but not rigid, material such as plastic. As described herein, the force mechanism can be manufactured of metal, such as steel, or any such material which achieves the desired results.

While the present invention has been shown and described with reference to the foregoing operational principles and preferred and proposed alternative embodiments, it will be apparent to those skilled in the art that the proposed alternative and other changes in form and detail may be made therein without departing from the spirit and scope of the invention as defined in the appended claims.

We claim:

1. Paper stack-handling apparatus for use in a printer, the apparatus comprising:

printer structure for supporting a variable height paper stack including a top sheet, the top sheet defining a first plane, and a pivotal member including a first end and a second end, the member including a top-of-stack contacting surface extending therebetween at an inclined angle relative to the first plane for contacting the top sheet of the variable height paper stack, said member being mounted adjacent said printer structure and biased for pivotal rotation in a plane generally parallel with the first plane to urge such top sheet into predefined lateral alignment within the printer, whereby the top-of-stack contacting surface contacts such top sheet at different locations therealong depending upon the height of the paper stack.

2. The apparatus of claim 1, wherein said pivotal member further includes a first generally planar expanse forming an acute angle with said first plane.

3. The apparatus of claim 2, wherein said pivotal member further includes a second generally planar expanse, generally parallel to said first plane, at least a portion of said second expanse positioned beneath at least a portion of the paper stack.

4. The apparatus of claim 1, wherein said top-of-stack contacting surface includes a continuum of contact regions for contacting said top sheet of a variable height paper stack.

5. The apparatus of claim 1, wherein said apparatus further comprises a force mechanism operatively connected with said pivotal member to bias said member.

6. The apparatus of claim 5, wherein said force mechanism includes a spring element to produce said bias.

7. The apparatus of claim 1, wherein said printer structure includes a stationary guide rail for extending along the paper stack on the other side of the paper stack from said pivotable member.

8. The apparatus of claim 7, wherein said pivotal member is generally slidable along said printer structure.

9. The apparatus of claim 8, wherein said pivotal member further includes a lead-in-surface to facilitate initial alignment of the paper stack against said guide rail upon manual placement of the paper stack on said printer structure.

10. Printer paper stack-handling apparatus comprising:

a pivotal member having a first generally planar expanse forming an acute angle with the planar surface of a paper stack, said expanse tapering along its length and having a first edge, a bottom edge and a top edge, said bottom and said top edges at least partly converging to produce said lengthwise tapering, said top edge defining a continuum of plural contact regions for contacting a top sheet of paper in a paper stack with the location of a given one of said contact regions along said continuum dependent upon paper stack height;

support structure pivotally mounting said member near said first edge, said support structure defining a pivot axis generally perpendicular to said planar surface; and a force mechanism operatively connected with said pivotal member to pivot said member about said pivot axis, thereby laterally to bias a top sheet of the paper stack that is in contact with said top edge into a desired position within the printer with a decrease in bias resulting from a decrease in paper stack height.

11. The apparatus of claim 10, wherein said pivotal member further includes a second generally planar expanse generally parallel to the paper stack's planar surface, at least a portion of said second expanse positioned beneath at least a portion of the paper stack.

12. The apparatus of claim 10, wherein said force mechanism includes a spring element to produce said bias.

13. The apparatus of claim 10, which further comprises a guide rail extending along one side of the paper stack, said guide rail positioned on the other side of the paper stack from said pivotal member.

14. The apparatus of claim 13, wherein said support structure is generally slidable along said printer structure.

15. The apparatus of claim 14, wherein said pivotal member further includes an inwardly angled lead-in-surface to facilitate initial alignment of the paper stack against said guide rail during placement of the paper stack on said printer structure.

16. Printer paper stack-handling apparatus to produce a variable top sheet bias comprising:

a generally planar printer structure to support a paper stack;

a pivotal member having a first generally planar expanse forming an acute angle with said printer structure, said pivotal member being positionable adjacent one side of said printer structure, said first expanse tapering along its length and having a first edge, a bottom edge and a top edge, said top edge at least partly converging toward said bottom edge to produce said lengthwise tapering, said top edge defining a continuum of contact points for contacting a top sheet of paper in a paper stack, a particular contact point location moving along said continuum away from said first edge with decreasing paper stack height;

a guide rail extending along the opposite side of said printer structure from said pivot member for aligning a paper stack on said printer structure;

support structure connected with said printer structure, said support structure pivotally mounting said pivot member adjacent said first edge, said support structure defining a pivot axis generally perpendicular to said printer structure; and a spring element operatively connected with said pivotal member to pivot said member about said pivot axis such that said top edge contacts a top sheet of the paper stack, thereby laterally to bias such top sheet into a desired position against said guide rail, with said spring element producing a variable moment in said member such that the top sheet bias decreases as the paper stack height decreases.

17. The apparatus of claim 16, wherein said pivotal member further includes a second generally planar expanse, generally parallel to said printer structure, at least a portion of said second expanse positioned beneath at least a portion of the paper stack.

18. The apparatus of claim 16, wherein said support structure is generally transversely slidable along said printer structure.

19. The apparatus of claim 16, wherein said pivot member further includes an inwardly angled lead-in-surface to facilitate initial alignment of the paper stack against said guide rail during placement of the paper stack on said printer structure.

20. The apparatus of claim 16, wherein said spring element includes a leaf spring to produce said bias.

* * * * *